US007384669B2

(12) United States Patent
Veck et al.

(10) Patent No.: US 7,384,669 B2
(45) Date of Patent: Jun. 10, 2008

(54) METHOD FOR PRINTING UNIDIRECTIONAL AND SEE-THROUGH GRAPHICS

(75) Inventors: Ronald Veck, Kingsbury (GB); Paul St-Pierre, Ottawa (CA); James Ramsden, Ottawa (CA); Trevor Simmonds, Ottawa (CA); Gordon Reynen, Greely (CA); David Evans, Ealing (GB)

(73) Assignee: CADlink Technology Corporation, Ontario (CA)

( * ) Notice: Subject to any disclaimer, the term of this patent is extended or adjusted under 35 U.S.C. 154(b) by 659 days.

(21) Appl. No.: 10/986,757

(22) Filed: Nov. 12, 2004

(65) Prior Publication Data

US 2005/0123707 A1 Jun. 9, 2005

(51) Int. Cl.
*B05D 5/06* (2006.01)

(52) U.S. Cl. ..... 427/258; 427/261; 427/265

(58) Field of Classification Search ..... 427/258, 427/261, 265

See application file for complete search history.

(56) References Cited

U.S. PATENT DOCUMENTS

| | | | |
|---|---|---|---|
| 4,673,609 | A | 6/1987 | Hill |
| 4,925,705 | A | 5/1990 | Hill |
| 5,773,110 | A | 6/1998 | Shields |
| 5,993,940 | A | 11/1999 | Ouderkirk et al. |
| 6,114,010 | A | 9/2000 | Williams |
| RE37,186 | E | 5/2001 | Hill |
| 6,254,711 | B1 | 7/2001 | Bull et al. |
| 6,458,464 | B1 | 10/2002 | Takeda |
| 2001/0006714 | A1 * | 7/2001 | Bull et al. ..... 428/40.1 |

* cited by examiner

*Primary Examiner*—Frederick J Parker
(74) *Attorney, Agent, or Firm*—Greenblum & Bernstein, P.L.C.

(57) ABSTRACT

A convenient, time-efficient, easy-to-use method for creating a substrate covering comprising graphic images, such that the substrate covering can be substantially opaque to an observer looking from one side of the substrate (allowing him to see an image), yet the observer is able to see through the substrate covering from the other side of the substrate, or such that an observer would be able to see the images as well as objects beyond the substrate, comprising the steps of (1) creating an outline for the substrate covering; (2) creating at least one artwork; (3) launching a window wizard, which allows a user to select the position of the covering with respect to the substrate; at least one artwork; and at least one primer in accordance with the desired visual effects; (4) selecting the position of the covering with respect to the substrate; at least one artwork; and at least one primer in accordance with the desired visual effects; and (5) sending the window wizard output for printing onto a substantially clear laminate that could be applied to the substrate, wherein stacked layers of the selected artwork and selected primers are printed with perforations onto said laminate, wherein the perforations of the stacked layers are aligned.

20 Claims, 9 Drawing Sheets

METHOD FOR PRINTING UNIDIRECTIONAL AND SEE-THROUGH GRAPHICS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

FIELD OF INVENTION

The present invention relates to creating graphic articles, and particularly, it relates to a method for creating graphic articles to be applied to a substantially clear substrate, such that articles can be substantially opaque to an observer looking from one side of the substrate, yet the observer is able to see through the articles from the other side of the substrate, or such that an observer would be able to see the graphic images as well as objects beyond the substrate.

BACKGROUND

Advertisers and merchants desire the ability to display graphic images on a wide variety of surfaces. In recent years, transparent surfaces such as windows, glass partitions (as found in shopping malls), and the like have attracted a great deal of attention as substrates for advertising media.

In certain applications, if a graphic article is applied to a transparent substrate, such as a window, it is desirable that the image be visible when viewed from one side of the window, while leaving the window and image substantially transparent when viewed from the other side of the window. For example, if the image is to be mounted on a window of a vehicle, such as a bus or taxicab, it is desired that passengers be able to see clearly through the window, while pedestrians outside of the vehicle see the graphic images.

In other applications, if a graphic article is applied to a transparent substrate, it is desirable that the viewer be able to see the image as well as objects beyond the substrate. For example, in such structures as banks where security is of importance, not being able to see out through the windows can present serious security problems, endangering the well-being of the bank customers and employees. Therefore, if the image is to be mounted on a window of a bank, it is desired that the bank customers inside the bank be able to see the advertising or promotional image, while bank employees (or security personnel) inside the bank be able to see clearly through the window.

Other applications may include applying two images to both sides of a laminate—one on each side—to be applied to a transparent substrate, where the first image is visible from one side of the substrate and not the other, and the second image is visible from the other side but not the first, while the viewer can still see through the substrate from either side.

Graphic articles achieving these visual effects typically are multi-layer film constructions with a light-colored, opaque film adapted to receive an image on one surface and a dark, light-absorbing film on the opposite surface. Numerous perforations through the film layers create an optical illusion of "transparency" through the graphic article.

In a unidirectional application, the multi-layer film constructions are stacked and the perforations are sized and spaced such that, when observed from the imaged side, a viewer has a tendency to focus on the image; however, when observed from the other side, the viewer has a tendency to see through the graphic article, leaving the window unobstructed.

In the see-through applications, the multi-layer film constructions are stacked and the perforations are sized and spaced such that, when observed from the imaged side of a single-sided graphic article, or either side of a double-sided graphic article, a viewer has a tendency to focus on the image or look through the graphic article, leaving the window unobstructed.

In all cases, vision through the graphic article can be obtained in either direction when the level of illumination perceived through the graphic article from the far side of the graphic article sufficiently exceeds the illumination reflected from the near side of the graphic article.

U.S. Pat. No. 4,673,609, to Hill, discloses a method of painting one-way graphics onto windows by the use of a mask applied to the window where paint goes through the holes to adhere directly to the glass. There are many problems associated with this method:

1. If the mask does not adhere properly, the paint will bleed under the mask and create unsightly irregular or ragged patterns of dots.

2. Removal of the mask may remove portions of the color or lift entire dots from the surface of the glass.

3. Removal of the graphics from the glass is labor intensive, requiring the use of aggressive window cleaning techniques, and the washed off or scraped off paint particles can stain the surrounding areas such as window frames or sills, wall areas, landscaping and walkways.

5. Multiple coats of paint are required to achieve the one-way graphics: first a dark (usually black) coat is applied, and then after the black coat has dried, at least one coat of the background color is required to cover the black coating.

6. One-way graphics painted directly onto glass require a significant investment of time—both in the application of several coats of paint and in the labor-intensive removal methods required.

A considerable advance in respect of such conventional methods is represented by the teachings of U.S. Pat. No. 5,773,110, to Shields: a window to be provided with a display product is masked with masking paper. A perforated panel is cut to fit the window and attached over the masking paper. The perforated panel is painted with an image that is desired. Once the painting is completed, the panel is taken away from the masking paper. The painted panel with the one or more layers of paint thereon is applied to the window. The perforated panel could have an adhesive coating that would have a protective backing liner to protect the adhesive. The perforated panel is peeled or separated from the backing masking paper, thus, leaving the holes of the perforated panel free as well as holes in the painted liner.

Problems comparable to the ones of Hill—even though less severe—exist with the teachings of Shields: if the adhesiveness of the masking paper used is potent, more paint than desired might be removed from the perforated panel (which has one or more layers of paint) while it is being peeled or separated from the backing masking paper. Alternatively, if the adhesiveness of the masking paper used is feeble, some of the holes of the perforated panel might not be freed during the peeling process.

Also, even though the method of Shields is less time consuming than Hill's, it is still desired to further improve on the time investment needed in the production of these graphic panels.

As can be readily seen, these methods of hand-painted graphics and other contemporary methods do not possess all of the desirable advantages required to adequately create unidirectional and see-through graphics. Thus, there is a need for a method for creating these graphics. The present invention satisfies that need.

SUMMARY OF THE INVENTION

To overcome the limitations of the prior art described above, and to overcome other limitations that will become apparent upon reading and understanding the present specification, the present invention accordingly provides a method for adequately creating unidirectional and see-through substrate coverings.

The present invention provides a convenient, time-efficient, easy-to-use method for creating a substrate covering comprising graphic images, such that the substrate covering can be substantially opaque to an observer looking from one side of the substrate (allowing him to see an image), yet the observer is able to see through the substrate covering from the other side of the substrate.

The present invention also provides a convenient, time-efficient, easy-to-use method for creating a substrate covering comprising graphic images, such that an observer would be able to see the images as well as objects beyond the substrate.

Both of these methods comprise the steps of (1) creating an outline for the substrate covering. (2) Creating at least one artwork. (3) Launching a window wizard, which allows a user to select the position of the covering with respect to the substrate; at least one artwork; and at least one primer in accordance with the desired visual effects; (4) selecting the position of the covering with respect to the substrate; at least one artwork; and at least one primer in accordance with the desired visual effects; and (5) sending the window wizard output for printing onto a substantially clear laminate to be applied to the substrate, wherein stacked layers of the selected artwork and selected primers are printed with perforations onto said laminate, wherein the perforations of the stacked layers are aligned.

In accordance with a further object of the present invention there is provided a method for creating a substrate covering comprising artwork, wherein said covering can be applied to at least a part of the surface of a substantially clear substrate, whereby a first observer looking at the covering from one side of the substrate would be able to observe the artwork as well as objects beyond the covering and the substrate, and a second observer looking at the covering from the other side of the substrate would be able to observe objects beyond the covering and the substrate, comprising the steps of creating an outline for the substrate covering; creating at least one artwork; launching a window wizard, which allows a user to select the position of the covering with respect to the substrate; at least one artwork; and at least one primer in accordance with the desired visual effects; selecting the position of the covering with respect to the substrate; at least one artwork; and at least one primer in accordance with the desired visual effects; and sending the window wizard output for printing onto a substantially clear laminate to be applied to the substrate, wherein stacked layers of the selected artwork and selected primers are printed with perforations onto said laminate, wherein the perforations of the stacked layers are aligned.

BRIEF DESCRIPTION OF THE DRAWINGS

The invention will be best understood by reference to the following detailed description taken in conjunction with the accompanying drawings, in which.

DETAILED DESCRIPTION OF THE INVENTION

Figure 1A:
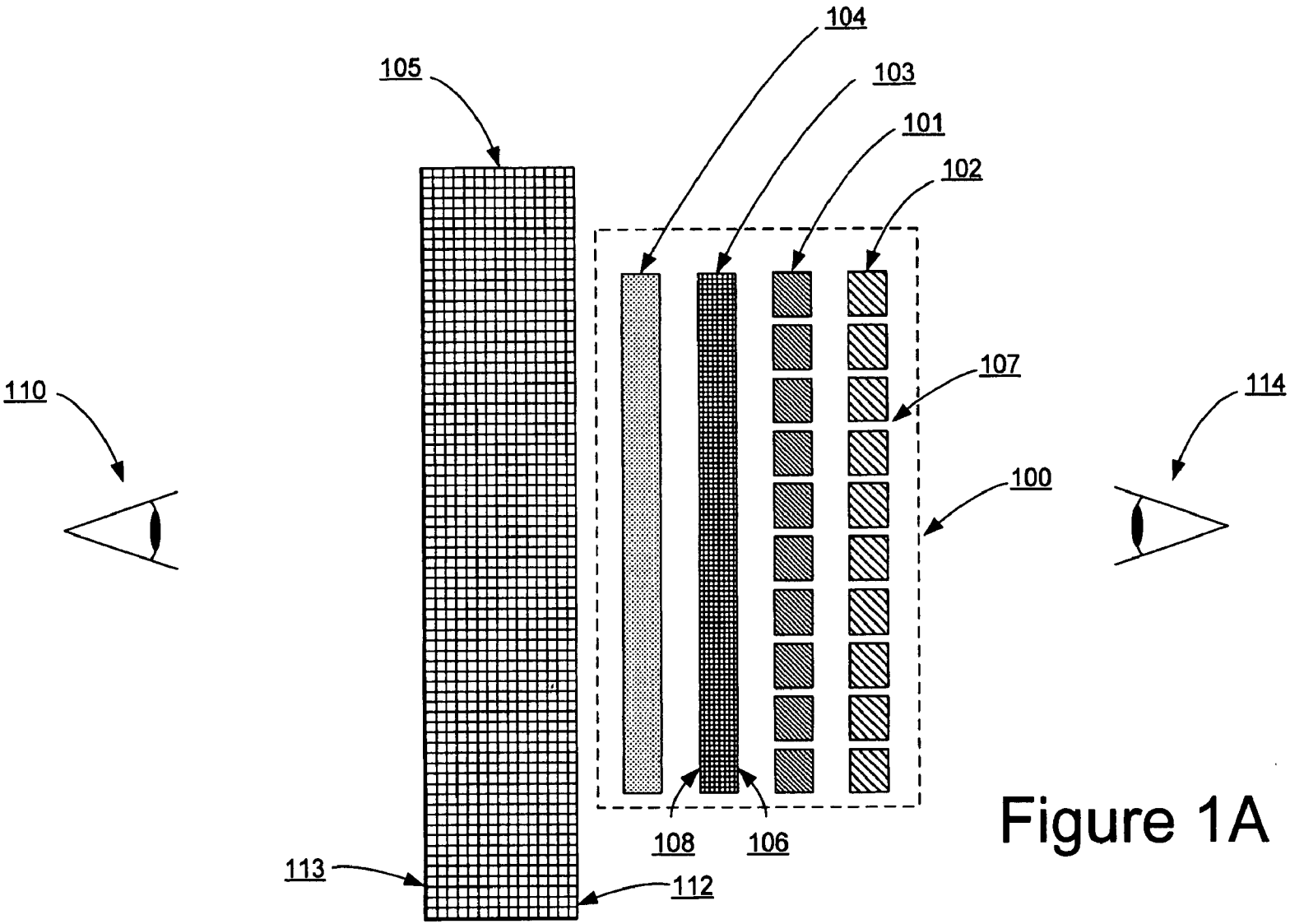
FIG. 1A is a schematic, cross-sectional view showing the layers of a graphic article, having a primary image only, to be applied to the interior surface of a substrate.

The following description is presented to enable any person skilled in the art to make use of the invention and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the embodiments shown and described are only illustrative, not restrictive; and the present invention is to be accorded the widest scope consistent with the principles and features disclosed herein.

It will be generally understood that the terms "graphic article" and "substrate covering" as used hereinafter are interchangeable and refer to graphic or informational articles that may be applied to a surface of a translucent or substantially clear substrate. Also, it will be generally understood that the terms "substantially clear," "clear" and "transparent" as used herein mean that an image applied on a "substantially clear," "clear" or "transparent" substrate can be viewed through the substrate such that the image is not substantially obscured.

The present invention provides a convenient, time-efficient, easy-to-use method for creating a substrate covering comprising graphic images, such that the substrate covering can be substantially opaque to an observer looking from one side of the substrate (allowing him to see an image), yet the observer is able to see through the substrate covering from the other side of the substrate, or such that an observer would be able to see the images as well as objects beyond the substrate, comprising the steps of (1) creating an outline for the substrate covering. (2) Creating at least one artwork. (3) Launching a window wizard, which allows a user to select the position of the covering with respect to the substrate; at least one artwork; and at least one primer in accordance with the desired visual effects; (4) selecting the position of the covering with respect to the substrate; at least one artwork; and at least one primer in accordance with the desired visual effects; and (5) sending the window wizard output for printing onto a substantially clear laminate that could be applied to the substrate, wherein stacked layers of the selected artwork and selected primers are printed with perforations onto said laminate, wherein the perforations of the stacked layers are aligned.

Unidirectional and see-through articles are widely used in the advertising industry and their design is considered to be well known to a person skilled in the art; therefore, unidirectional and see-through articles in themselves do not constitute any part of the present invention. However, since the present invention stems from the design of these articles, their construction and operation are discussed below as a precursor to a discussion of the present invention—namely, a convenient, time-efficient, easy-to-use method for creating them.

FIG. 1A is a schematic, cross-sectional view of the layers of a unidirectional graphic article 100 to be applied to the interior surface of a window 105. As shown in FIG. 1A, the graphic article 100 includes a substantially clear adhesive layer 104, a substantially clear laminate layer 103, a perforated image layer 101, and a perforated primer layer 102. (The perforations of the image layer 101 and the perforations of the primer layer 102 are collectively designated by reference No. 107.)

The laminate layer 103 is provided with a first major surface 106 and a second major surface 108. The first major surface 106 of the laminate layer 103 is designed to receive the perforated image layer 101. As is well known in the art, the surfaces of the laminate layer 103 may be modified or may include additional layers to enhance adhesion of a particular ink, dye or toner.

The adhesive layer 104 is applied to the second major surface 108 of the laminate layer 103. The adhesive layer 104 is used to apply the graphic article 100 to a substantially transparent substrate 105. Any known adhesive may be used, as long is it is substantially clear. Also, it is particularly preferred that the adhesive used to form the adhesive layer 104 be removable from the substrate 105. As used herein, the term "removable" means that the adhesive layer 104 should preferably be selected to permit the graphic article 100 to be easily removed from the substrate 105 without leaving substantial adhesive residue on the substrate 105.

To provide the graphic article 100 with unidirectional properties, the image layer 101 and the primer layer 102 are perforated with a plurality of perforations or apertures 107. The diameter of each aperture 107 may vary widely depending on the required density to match the desired viewing distance. The apertures 107 may be circular, square, triangular or any other shape, and may form a regular or irregular repeating pattern. It is preferred that about 50% of the surface area of the image layer 101 and the primer layer 102 comprise open space.

Figure 1B:
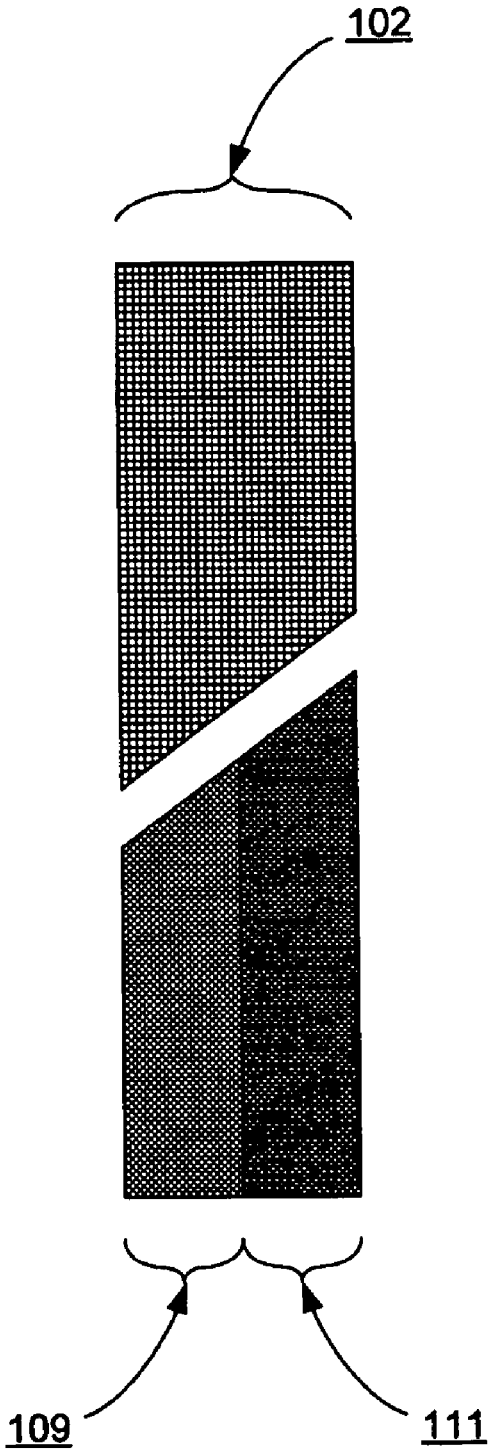
FIG. 1B is a schematic, cross-sectional view showing the different layers of the primer.

As shown in FIG. 1B, the primer layer 102 usually comprises two pigment layers 109, 111. The first pigment layer 111 is an opaque, light-absorbing pigment, typically darkly colored (preferably black). The first pigment layer 111 may be engineered to provide any desired appearance or finish, and a matte finish is desired for most interior surface window applications, where the light-absorbing pigment layer 111 is normally exposed to the viewer (as will be explained below and demonstrated in FIGS. 1C and 3).

The second pigment layer 109 applied over the light-absorbing pigment layer 111 is a light-reflecting pigment layer. Typically, the light-reflecting pigment layer 109 is lightly colored (preferably white). The image layer 101 is applied to the pigment layer 109 of the primer layer 102. As is well known in the art, the surfaces of the pigment layer 109 may be modified or may include additional layers to enhance adhesion.

Figure 1C:
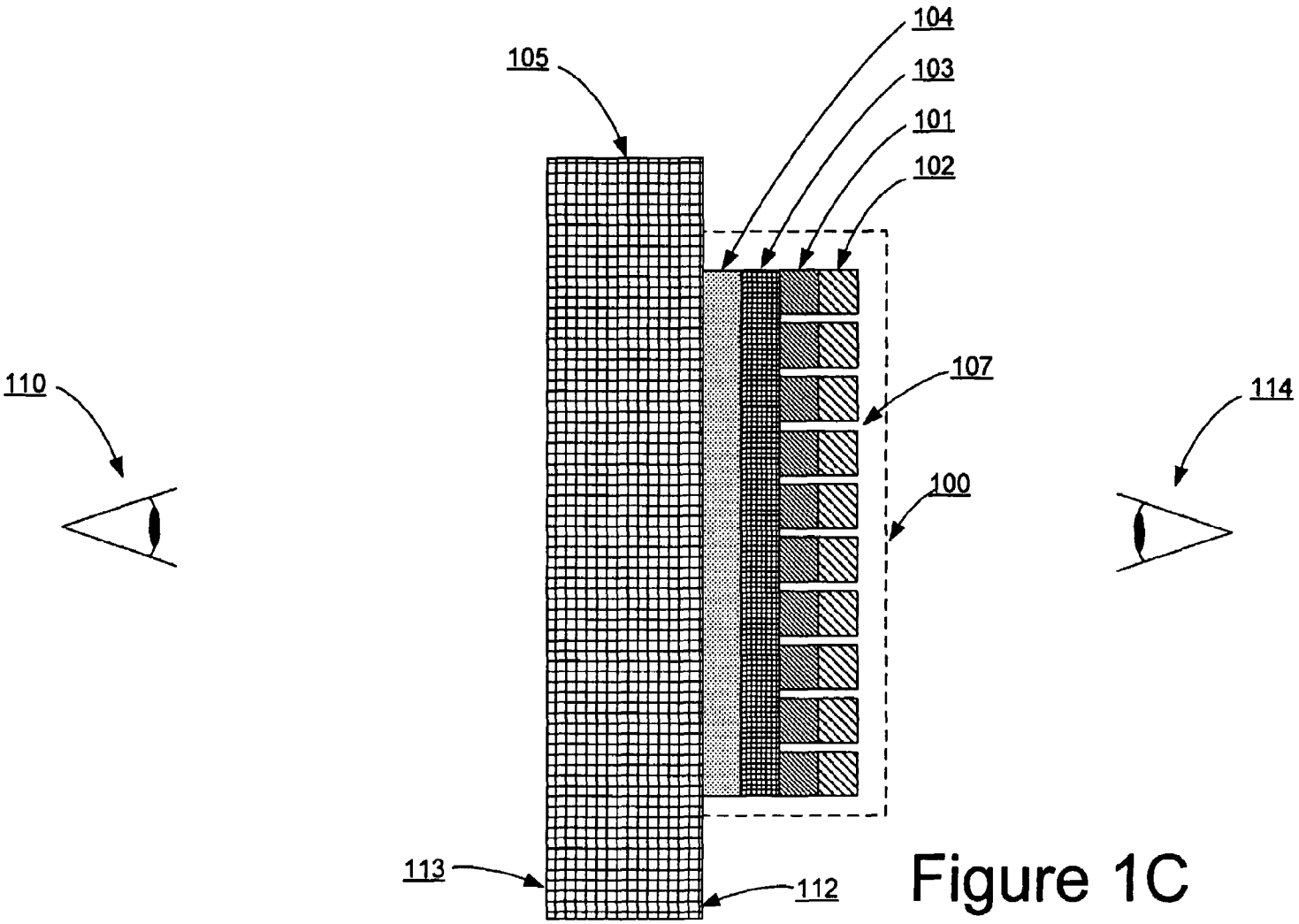
FIG. 1C is a schematic, cross-sectional view of a graphic article, having a primary image only, and applied to the interior surface of a substrate.

FIG. 1C is a schematic, cross-sectional view showing the unidirectional graphic article 100 applied to the interior surface 112 of a window 105. The graphic article 100 can be applied to cover the whole window 105 or to cover a part of it. After the completed graphic article 100 is applied to the interior surface 112 of the window substrate 105, a first observer 110 looking directly at the exterior surface 113 of the window 105 will see through the window 105, the adhesive layer 104, and the laminate layer 103, and observe the image layer 101. A second observer 114 (on the interior side) looking at the window covering will see through the apertures 107 in the primer layer 102 and image layer 101, and see light through the window 105. The second observer 114 will not see the image layer 101 under normal lighting conditions.

(In the following descriptions and their associated figures, like parts have been given the same reference numerals.)

Figure 2:
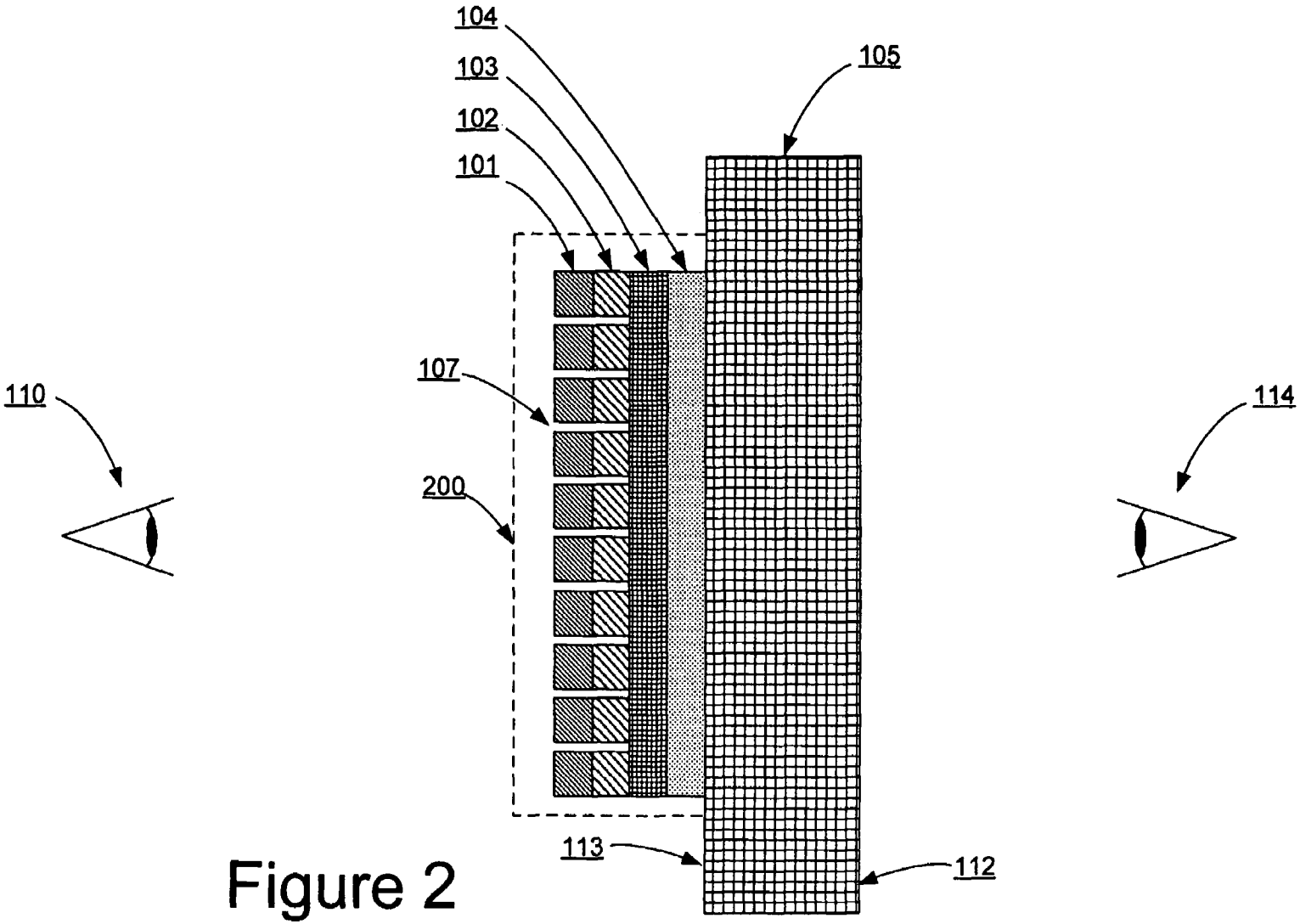
FIG. 2 is a schematic, cross-sectional view of a graphic article, having a primary image only, and applied to the exterior surface of a substrate.

FIG. 2 is a schematic, cross-sectional view showing a unidirectional graphic article 200 applied to the exterior surface 113 of a window 105. As can readily be concluded, the adhesive layer 104, the laminate layer 103, the perforated image layer 101, and the perforated primer layer 102 are rearranged to accommodate the application of the graphic article 200 to the exterior surface 113 of the window 105. The needed arrangement is obvious and shown in FIG. 2. Note, however, that the arrangement of the two pigment layers 109, 111 of the primer layer 102 remain the same, where the image layer 101 is applied to the pigment layer 109 of the primer layer 102.

After the completed graphic article 200 is applied to the exterior surface 113 of the window substrate 105, a first observer 110 (on the exterior side) looking directly at the window covering 200 will observe image layer 101. A second observer 114 looking directly at the interior surface 112 of the window 105 will see through the window 105, the adhesive layer 104, and the laminate layer 103, and will see through the apertures 107 in the primer layer 102 and image layer 101, and see light through the window 105. The second observer 114 will not see the image layer 101 under normal lighting conditions.

Figure 3:
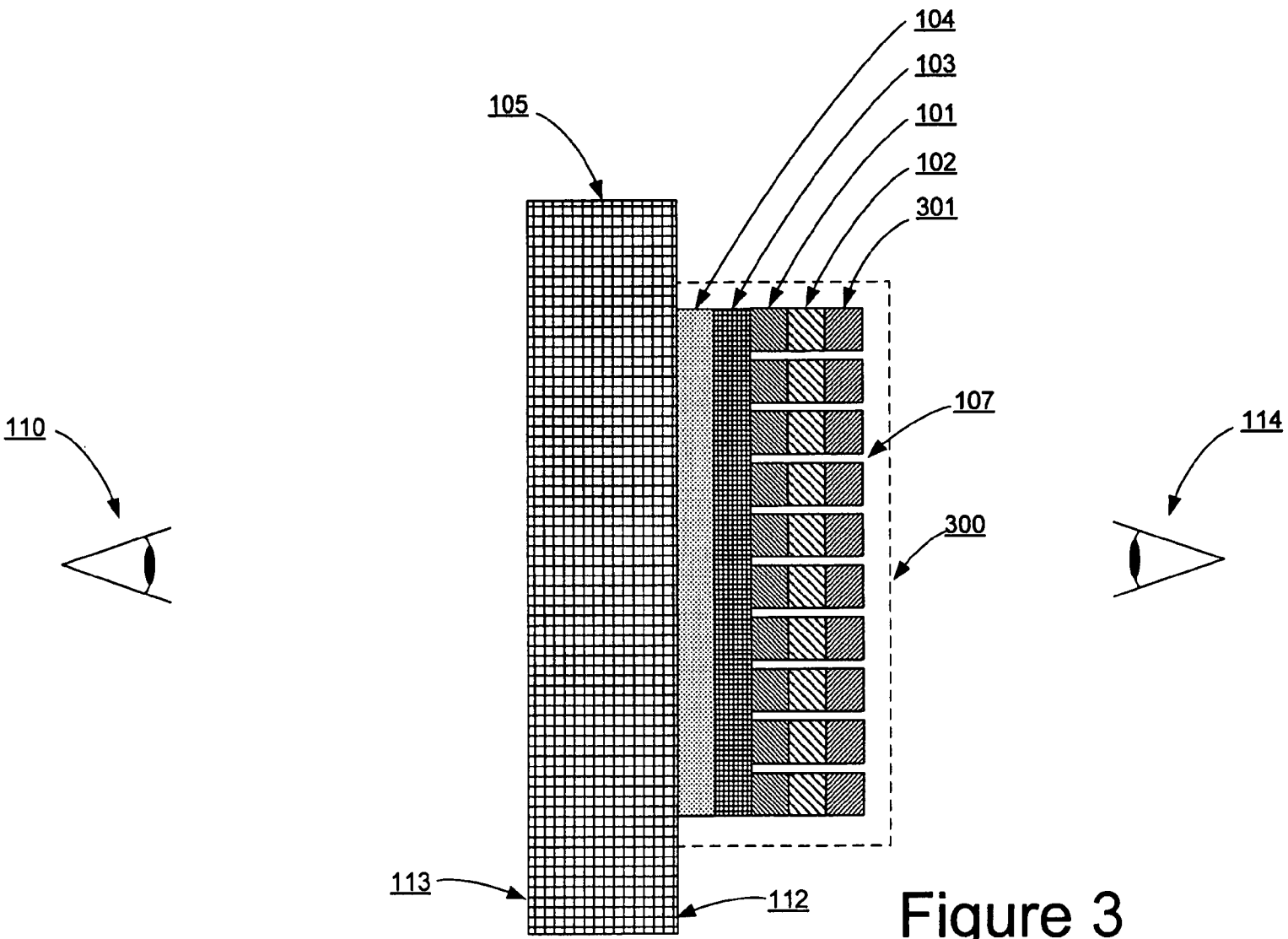
FIG. 3 is a schematic, cross-sectional view of a graphic article, having both a primary image and a secondary image, and applied to the interior surface of a substrate.

FIG. 3 is a schematic, cross-sectional view showing a unidirectional graphic article 300 similar to that of FIG. 1, except that it comprises a second perforated image layer 301 applied to the other surface of the primer layer 102 (alongside the light-absorbing pigment layer 111 ) such that a first observer 110 looking directly at the exterior surface 113 of the window 105 will see through the window 105, the adhesive layer 104, and the laminate layer 103, and observe the artwork of the first image layer 101. A second observer 114 (on the interior side) looking at the window covering 300 would be able to see the artwork of the second image layer 301, and would also be able to see through the apertures 107 in the second image layer 301, the primer layer 102 and the first image layer 101, and see light through the window 105—in other words, the graphic article 300, apart from the second image layer 301, would appear transparent from the back.

Figure 4:
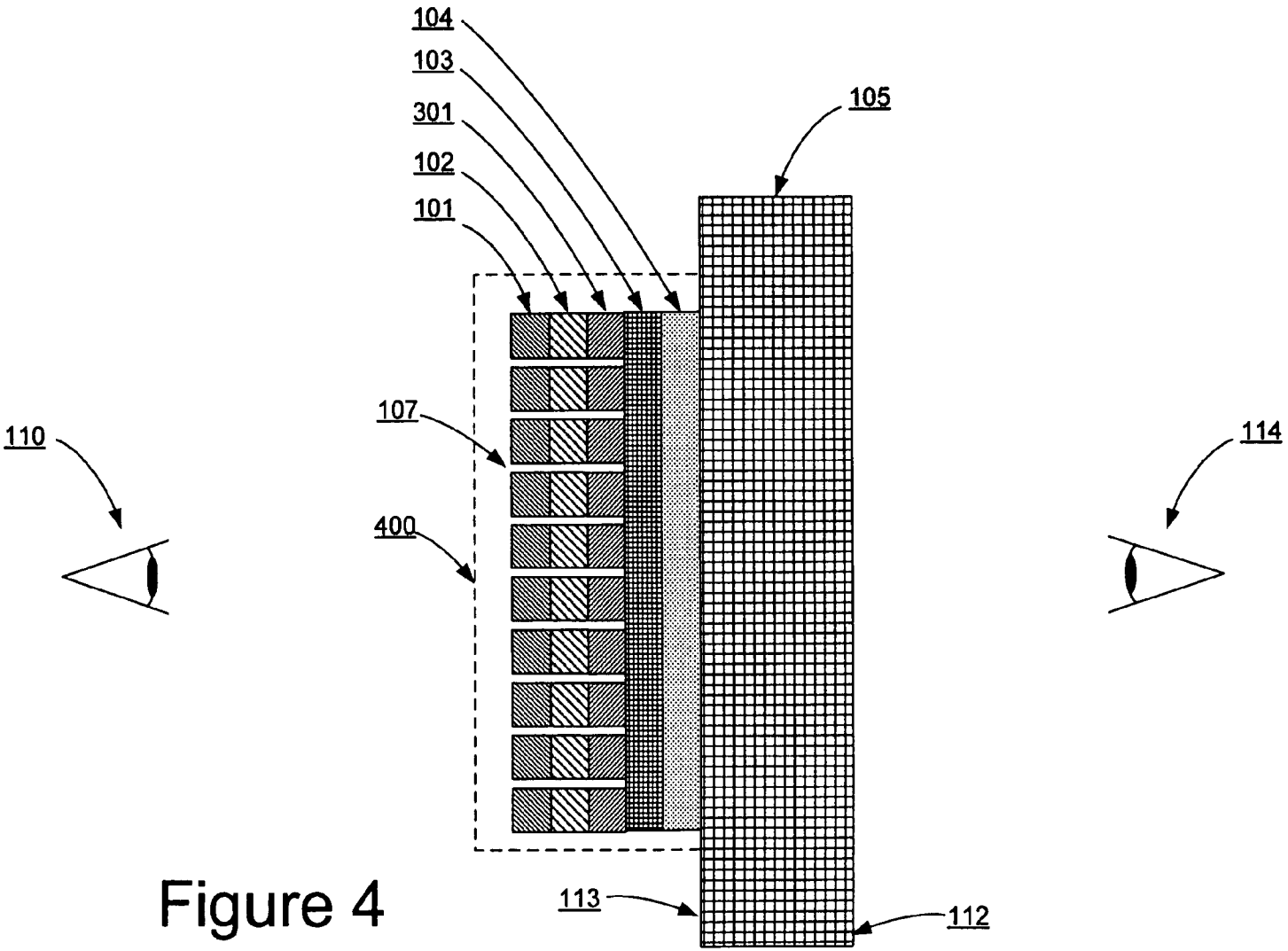
FIG. 4 is a schematic, cross-sectional view of a graphic article, having both a primary image and a secondary image, and applied to the exterior surface of a substrate.

FIG. 4 is a schematic, cross-sectional view showing a unidirectional graphic article 400 similar to that of FIG. 2, except that it comprises a second perforated image layer 301 applied to the other surface of the primer layer 102 (alongside the light-absorbing pigment layer 111) such that a first observer 110 (on the exterior side) looking directly at the window covering 400 will observe the first image layer 101. A second observer 114 looking directly at the interior surface 112 of the window 105 will see through the window 105, the adhesive layer 104, and the laminate layer 103, and would be able to see the artwork of the second image layer 301, and would also be able to see through the apertures 107 in the second image layer 301, the primer layer 102 and the first image layer 101, and see light through the window 105.

In all of the above-described embodiments, visibility from one side of a graphic article to the other side can be totally or partially obstructed while there is clarity of vision through the graphic article (except in the area of the graphic design) from the other side to the one side—in other words, a unidirectional vision effect is obtained.

By modifying the pigment layers 109, 111 of the primer layer 102 used in these unidirectional graphic articles, see-through visual effects could be obtained: vision can be obtained in either direction through a graphic article when the level of illumination perceived through the graphic article from the far side of the graphic article sufficiently exceeds the illumination reflected from the near side of the graphic article. In the cases of see-though window coverings, an observer would be able to see the images of the window coverings as well as objects beyond the transparent substrate.

See-through graphic articles will not be discussed in greater detail. It is assumed that one can easily understand their principles from reading the description of the unidirectional graphic articles above. As stated earlier, unidirectional and see-through articles in themselves do not constitute any part of the present invention.

Figure 5:
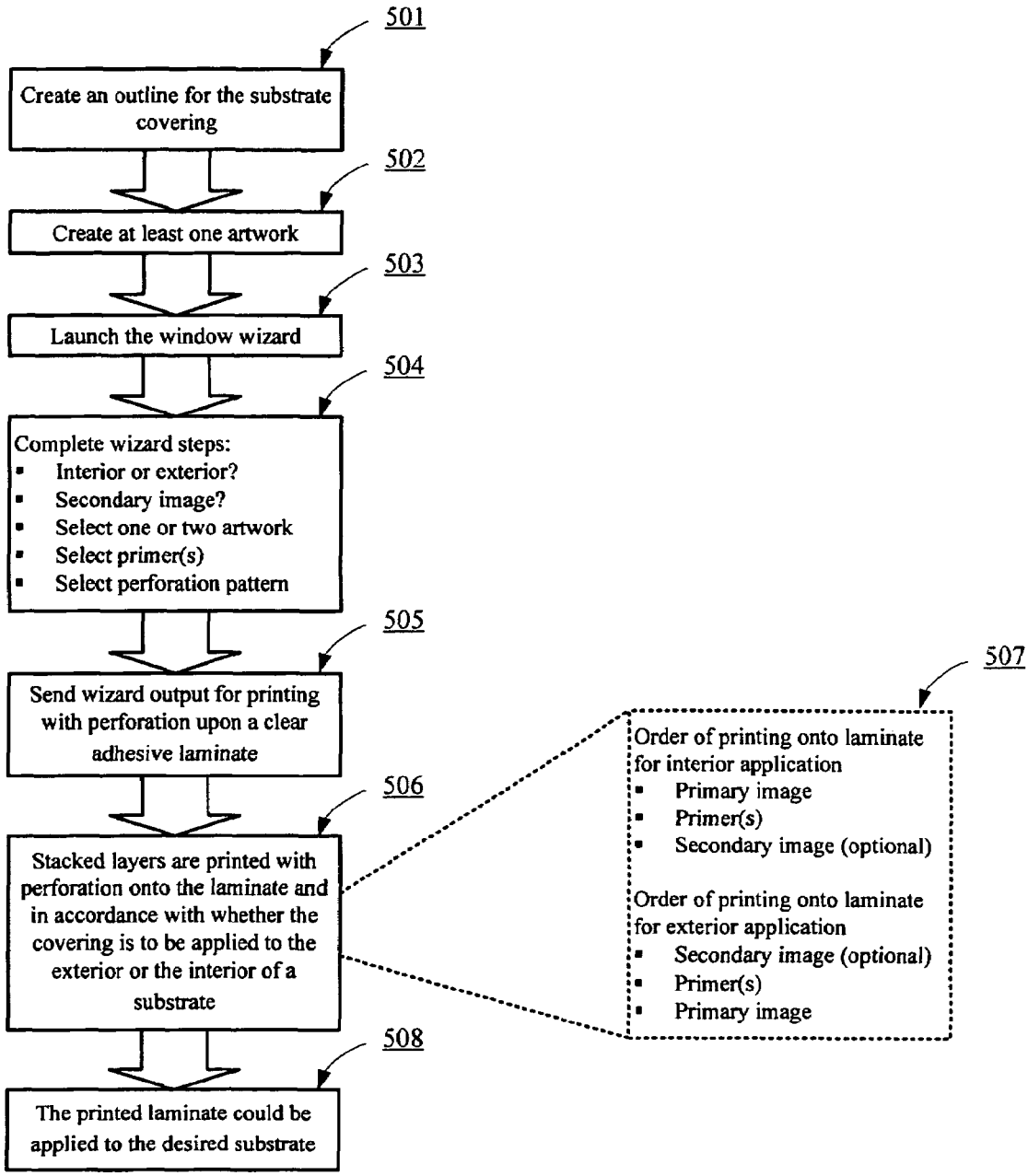
FIG. 5 is a flow chart illustrating the method for producing graphic articles according to the present invention.

The present invention provides a convenient, time-efficient, easy-to-use method for creating such unidirectional and see-through substrate coverings. FIG. 5 is a flow chart illustrating that method.

Referring to FIG. 5, the first step of the method is to create an outline for the substrate covering 501, which is the line art shape (such as a rectangle) that represents the substrate surface area to which images will be applied. The outline could be created as to cover the whole substrate or to cover a part of it.

At least one artwork, which will be stored in a database for later use, should be created 502.

The next step of the method is to launch a window wizard 503. The window wizard takes into consideration the graphic image(s) that will be visible from either side of the window; the primer layer(s) to be applied to a graphic image or between graphic images; the perforation pattern that will allow viewers to see beyond the window covering; and the order in which the image layer(s) and the primer layer(s) must be printed onto a clear adhesive laminate, in order that the covering could be applied to the interior or exterior of the substrate. (Note that the laminate layer 604 used in the process of the present invention inherently comprises an adhesive layer for application to the substrate 605. (See FIGS. 6 and 7.)

By utilizing the window wizard 504, whether the covering 600 is to be applied to the interior (FIG. 6) or exterior (FIG. 7) of the substrate 605 is selected; whether or not a "secondary image" 603 is required is specified (the demonstrations of FIGS. 6 and 7 include a secondary image); and artwork for the "primary image" 601, or for both the primary image 601 and the secondary image 603 is selected. As an alternative to creating a distinct artwork for the secondary image, one could select the same artwork for both the primary image 601 and the secondary image 603.

The "primary image" 601 is the main image that will be visible either through the window 605 with respect to the viewing position (FIG. 6), or on the front of the window 605 with respect to the viewing position (FIG. 7), and the optional "secondary image" 603 is the one that will be visible from the viewing position opposite to the primary image with respect to the primer layer 602. (This will be explained in more detail below.)

Figure 6:
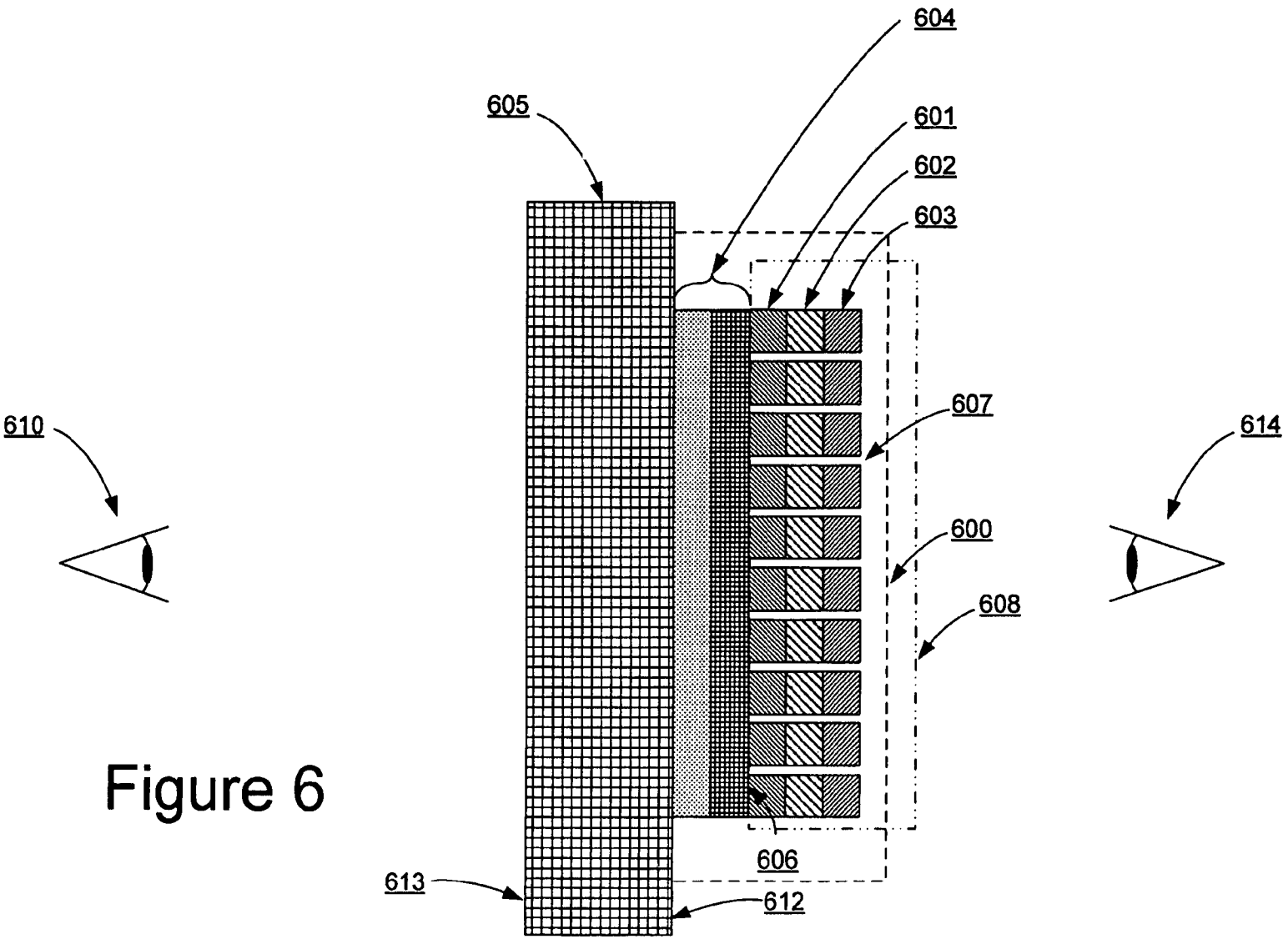
FIG. 6 is a schematic, cross-sectional view of a graphic article produced by the method of the present invention, having both a primary image and a secondary image, and applied to the interior surface of a substrate.
Figure 7:
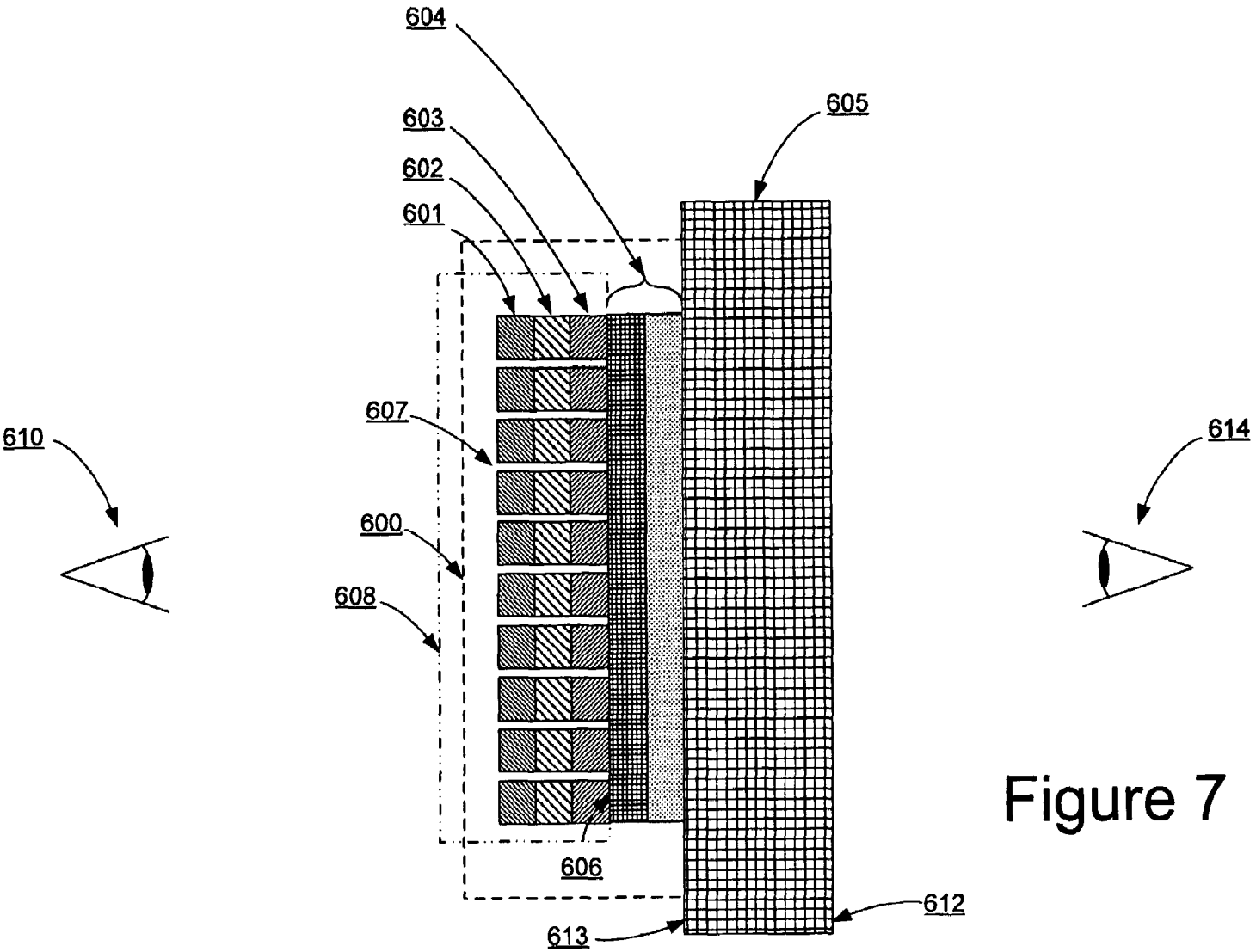
FIG. 7 is a schematic, cross-sectional view of a graphic article produced by the method of the present invention, having both a primary image and a secondary image, and applied to the exterior surface of a substrate

A primer layer to be applied to a graphic image or between graphic images is selected—from the available selections provided by the window wizard—in accordance with whether the covering is to be created for a unidirectional application or a see-through application, and in accordance with the desired visual effect for each application 504. Also, extra primer layers that are used to prevent silhouettes from appearing behind the printed image could be selected 504. Where both primary and secondary images are used, these extra primer layers are especially important to prevent the underlying image from showing through, such as from intense sunlight. (FIGS. 6 and 7 provide an illustration of the present invention showing only one primer layer 602.)

In addition, the perforation size and shape for the desired visual effect are selected from the available patterns provided by the window wizard 504, and the selected pattern will be tiled across the covering. The window wizard also provides the user with the option of creating a custom perforation pattern.

Once these specifications/selections have been made 504, the window wizard output is sent for printing with perforations 505 upon the non-adhesive surface 606 of the laminate 604. The perforation is integrated during the printing process in such a way that the perforations of stacked layers 608—namely, the primary image layer, the primer layer, and the optional second image layer—are perfectly aligned as shown in FIGS. 6 and 7; and, of course, these layers are printed onto the laminate with their outlines aligned with the outline of the substrate covering created earlier 501.

The stacked layers 608 are printed with perforations onto the clear adhesive laminate 506 in accordance with whether the covering is to be applied to the exterior or the interior of the substrate 507.

Note that the laminate itself is not perforated. This provides advantages over perforated laminates both in terms of ease of application to the window surface, as well as the periodic cleaning and maintenance of the artwork surface. To ensure good adhesion to the substrate surface [612 or 613], it can be necessary to remove surface dirt, chemical residues and liquids from the surface prior to application of the window covering to it 508. Typically, the window covering is smoothly and flatly applied in one continuous motion. The window covering can be "squeegeed" flat by a roller to remove entrapped air and to provide a good adhesive bond with the underlying window surface [612 or 613].

FIG. 6 demonstrates a see-through window covering 600 produced by the process of the present invention, having both a primary image 601 and a secondary image 603, and applied to the interior surface 612 of a substrate 605. In this case (the case of interior applications), the artwork selected for the primary image 601 is reverse applied—flipped horizontally before application—to the non-adhesive surface 606 of the laminate 604.

After the completed window covering 600 is applied to the interior surface 612 of the window substrate 605, a first observer 610 looking directly at the exterior surface 613 of the window 605 will see through the window 605, the adhesive laminate layer 604, and see the primary image layer 601. As well, said observer 610 will be able to see through the apertures 607 in the primary and secondary image layers 601, 603 and the primer layer 602, and see light through the window 605. A second observer 614 (on the interior side) looking at the covering 600 will see the secondary image layer 601, and will see through the apertures 607 in the primary and secondary image layers 601, 603 and the primer layer 602, and see light through the window 605 as well.

The above describes a see-through application, where the primer layer 602 and the perforations 607 are selected to provide such an effect. The case of having a unidirectional window covering, applied to the interior surface 612 of the window substrate 605, could be readily understood from the description of FIG. 6 in combination with the description of FIG. 1C.

FIG. 7 demonstrates a see-through window covering 600 produced by the process of the present invention, having both a primary image 601 and a secondary image 603, and applied to the exterior surface 613 of a substrate 605. (As is readily obvious, the artwork selected for the primary image 601 is not reverse applied in this case.)

After the completed window covering 600 is applied to the exterior surface 613 of the window substrate 605, a first observer 610 looking directly at the covering 600 will see the primary image layer 601, and will see through the apertures 607 in the primary and secondary image layers 601, 603 and the primer layer 602, and see light through the window 605. A second observer 614 (on the interior side) looking at the interior surface 612 of the window 605 will see through the window 605, the adhesive laminate layer 604, and see the secondary image layer 603. As well, the second observer 614 will be able to see through the apertures 607 in the primary and secondary image layers 601, 603 and the primer layer 602, and see light through the window 605.

The case of having a unidirectional window covering, applied to the exterior surface 613 of the window substrate 605, could be readily understood from the description of FIG. 7 in combination with the description of FIG. 2.

Other embodiments and uses of the invention will be apparent to those skilled in the art from consideration of the specification and practice of the invention disclosed herein. The specification and examples should be considered exemplary only and do not limit the intended scope of the invention.

We claim:

1. A method for creating a substrate covering comprising artwork, wherein said covering can be applied to at least a part of the surface of a substantially clear substrate, whereby the covering can be substantially opaque to a first observer looking at the covering from one side of the substrate, allowing said first observer to observe the artwork, and substantially see-through to a second observer looking at the covering from the other side of the substrate, allowing said second observer to observe objects beyond the covering and the substrate, comprising the steps of:

a) creating an outline for the substrate covering;

b) creating at least one artwork;

c) launching a window wizard, which allows a user to select the position of the covering with respect to the substrate; at least one artwork; and at least one primer in accordance with the desired visual effects;

d) selecting the position of the covering with respect to the substrate; at least one artwork;

and at least one primer in accordance with the desired visual effects; and e) sending the window wizard output for printing onto a substantially clear laminate to be applied to the substrate, wherein stacked layers of the selected artwork and selected primers are printed with perforations onto said laminate, wherein the perforations of the stacked layers are aligned.

2. The method of claim 1, wherein said covering further comprises artwork on both sides, whereby said second observer looking at the covering from said other side of the substrate is able to observe artwork as well as objects beyond the covering and the substrate.

3. The method of claim 2, wherein the same artwork can be observed from both sides of the substrate.

4. The method of claim 2, wherein the artwork observed from said one side of the substrate is different from the artwork observed from said other side of the substrate.

5. The method of claim 1, further comprising selecting a perforation pattern, in accordance with the desired visual effects, from available patterns provided by the window wizard, to be integrated during the printing process.

6. The method of claim 1, further comprising creating a custom perforation pattern, in accordance with the desired visual effects, to be integrated during the printing process.

7. The method of claim 1, wherein the substantially clear laminate is not perforated.

8. The method of claim 1, wherein the substantially clear laminate comprises a substantially clear layer of adhesive material.

9. The method of claim 8, wherein the adhesive material is removable from the substrate.

10. A method for creating a substrate covering comprising artwork, wherein said covering can be applied to at least a part of the surface of a substantially clear substrate, whereby a first observer looking at the covering from one side of the substrate would be able to observe the artwork as well as objects beyond the covering and the substrate, and a second observer looking at the covering from the other side of the substrate would be able to observe objects beyond the covering and the substrate, comprising the steps of:

a) creating an outline for the substrate covering;

b) creating at least one artwork;

c) launching a window wizard, which allows a user to select the position of the covering with respect to the substrate; at least one artwork; and at least one primer in accordance with the desired visual effects;

d) selecting the position of the covering with respect to the substrate; at least one artwork; and at least one primer in accordance with the desired visual effects; and e) sending the window wizard output for printing onto a substantially clear laminate to be applied to the substrate, wherein stacked layers of the selected artwork and selected primers are printed with perforations onto said laminate, wherein the perforations of the stacked layers are aligned.

11. The method of claim 10, wherein said covering further comprises artwork on both sides, whereby said second observer looking at the covering from said other side of the substrate is able to observe artwork as well as objects beyond the covering and the substrate.

12. The method of claim 11, wherein the same artwork can be observed from both sides of the substrate.

13. The method of claim 11, wherein the artwork observed from said one side of the substrate is different from the artwork observed from said other side of the substrate.

14. The method of claim 10, further comprising selecting a perforation pattern, in accordance with the desired visual effects, from available patterns provided by the window wizard, to be integrated during the printing process.

15. The method of claim 10, further comprising creating a custom perforation pattern, in accordance with the desired visual effects, to be integrated during the printing process.

16. The method of claim 10, wherein the substantially clear laminate is not perforated.

17. The method of claim 10, wherein the substantially clear laminate comprises a substantially clear layer of adhesive material.

18. The method of claim 17, wherein the adhesive material is removable from the substrate.

19. A method for printing unidirectional and see-through substrate coverings, wherein stacked layers are printed with perforation onto a substantially clear laminate once the position of the covering with respect to the substrate, at least one artwork, and at least one primer in accordance with the desired visual effects have been selected.

20. The method of claim 19 further comprising selecting a perforation pattern prior to the printing process.

* * * * *